US010293358B2

(12) United States Patent
Alluigi

(10) Patent No.: US 10,293,358 B2
(45) Date of Patent: May 21, 2019

(54) TRIGGER DISPENSER DEVICE WITH A VENTING VALVE

(71) Applicant: GUALA DISPENSING S.p.A., Alessandria (IT)

(72) Inventor: Riccardo Alluigi, Alessandria (IT)

(73) Assignee: GUALA DISPENSING S.p.A., Alessandria (IT)

( * ) Notice: Subject to any disclaimer, the term of this patent is extended or adjusted under 35 U.S.C. 154(b) by 65 days.

(21) Appl. No.: 15/311,462

(22) PCT Filed: May 25, 2015

(86) PCT No.: PCT/IB2015/053866

§ 371 (c)(1),
(2) Date: Nov. 15, 2016

(87) PCT Pub. No.: WO2016/005831

PCT Pub. Date: Jan. 14, 2016

(65) Prior Publication Data

US 2017/0080443 A1 Mar. 23, 2017

(30) Foreign Application Priority Data

Jul. 11, 2014 (IT) ..... BS2014A0125

(51) Int. Cl.
*B05B 11/00* (2006.01)

(52) U.S. Cl.
CPC ..... *B05B 11/3033* (2013.01); *B05B 11/0039* (2018.08); *B05B 11/00442* (2018.08); *B05B 11/303* (2013.01); *B05B 11/3035* (2013.01); *B05B 11/3045* (2013.01); *B05B 11/3057* (2013.01)

(58) Field of Classification Search
CPC ..... B05B 11/3033; B05B 11/0018; B05B 11/3011
USPC ..... 222/383.1, 209
See application file for complete search history.

(56) References Cited

U.S. PATENT DOCUMENTS

| | | | | |
|---|---|---|---|---|
| 3,987,938 | A * | 10/1976 | Cooprider | B05B 11/3032 222/209 |
| 8,365,962 | B2 | 2/2013 | Canfield | |
| 8,517,221 | B2 * | 8/2013 | Sweeton | B05B 11/303 222/153.13 |
| 2006/0186139 | A1 * | 8/2006 | Laidler | B05B 11/0027 222/207 |
| 2009/0173751 | A1 | 7/2009 | Laidler et al. | |
| 2010/0219207 | A1 * | 9/2010 | Canfield | B05B 11/0016 222/207 |

FOREIGN PATENT DOCUMENTS

| | | | |
|---|---|---|---|
| JP | 2007-203128 | A | 8/2007 |
| WO | 2004/080607 | A1 | 9/2004 |
| WO | 2011/128788 | A1 | 10/2011 |

OTHER PUBLICATIONS

International Search Report and Written Opinion of the International Searching Authority for International Patent Application No. PCT/IB2015/053866 dated Sep. 17, 2015, 9 pgs.

* cited by examiner

*Primary Examiner* — Jeremy Carroll
(74) *Attorney, Agent, or Firm* — Merchant & Gould P.C.

(57) ABSTRACT

A head (10) of a trigger dispenser device includes a bulb (70) having an elastically deformable casing (72) that includes a vent lip (90), molded in one piece. With the casing (72), the vent lip (90) forms a venting valve.

13 Claims, 7 Drawing Sheets

TRIGGER DISPENSER DEVICE WITH A VENTING VALVE

This application is a National Stage Application of PCT/IB2015/053866, filed 25 May 2015, which claims benefit of Serial No. BS2014A000125, filed 11 Jul. 2014 in Italy and which applications are incorporated herein by reference. To the extent appropriate, a claim of priority is made to each of the above disclosed applications.

BACKGROUND OF THE INVENTION

This invention covers a manual trigger-dispensing device for liquids, for example for the hygiene of the home, the deodorization of rooms, the treatment of fabrics before ironing, and the like.

Trigger devices are very widespread, as can be seen on supermarket shelves, especially for their ease of use and functionality. Every year many hundreds of millions of pieces are produced.

It is therefore well understood as a structural simplification of the device, for example in the sense of a reduction in the number of components, is particularly appreciable, since it allows a considerable reduction in production and assembly costs.

For these reasons, numerous solutions have been developed in which one or more valve devices of the dispensing head are integrated in other components.

For example, the document U.S. Pat. No. 8,365,962 shows a trigger dispensing in which the vent valve, which allows the passage of air from the outside environment into the bottle during the suction phase of the liquid and prevents the escape of liquid from the bottle to the external environment during the other operating phases, is integrated with the deformable bulb that creates the pressure chamber.

However, it is essential that these simplified-structure solutions maintain excellent functionality; in the case of the integration of the vent valve, for example, the Applicant has observed that drawbacks may arise due to an excessive rigidity that does not allow the rapid entry of air into the bottle during the suction phase of the liquid.

SUMMARY OF THE INVENTION

The purpose of this invention is to provide a manual trigger dispensing device that overcomes the drawbacks mentioned with reference to the prior art.

BRIEF DESCRIPTION OF THE DRAWINGS

The characteristics and advantages of the device according to this invention will be apparent from the following description, given by way of non-limiting example, in accordance with the accompanying figures, wherein.

DETAILED DESCRIPTION OF THE DRAWINGS

Figure 1:
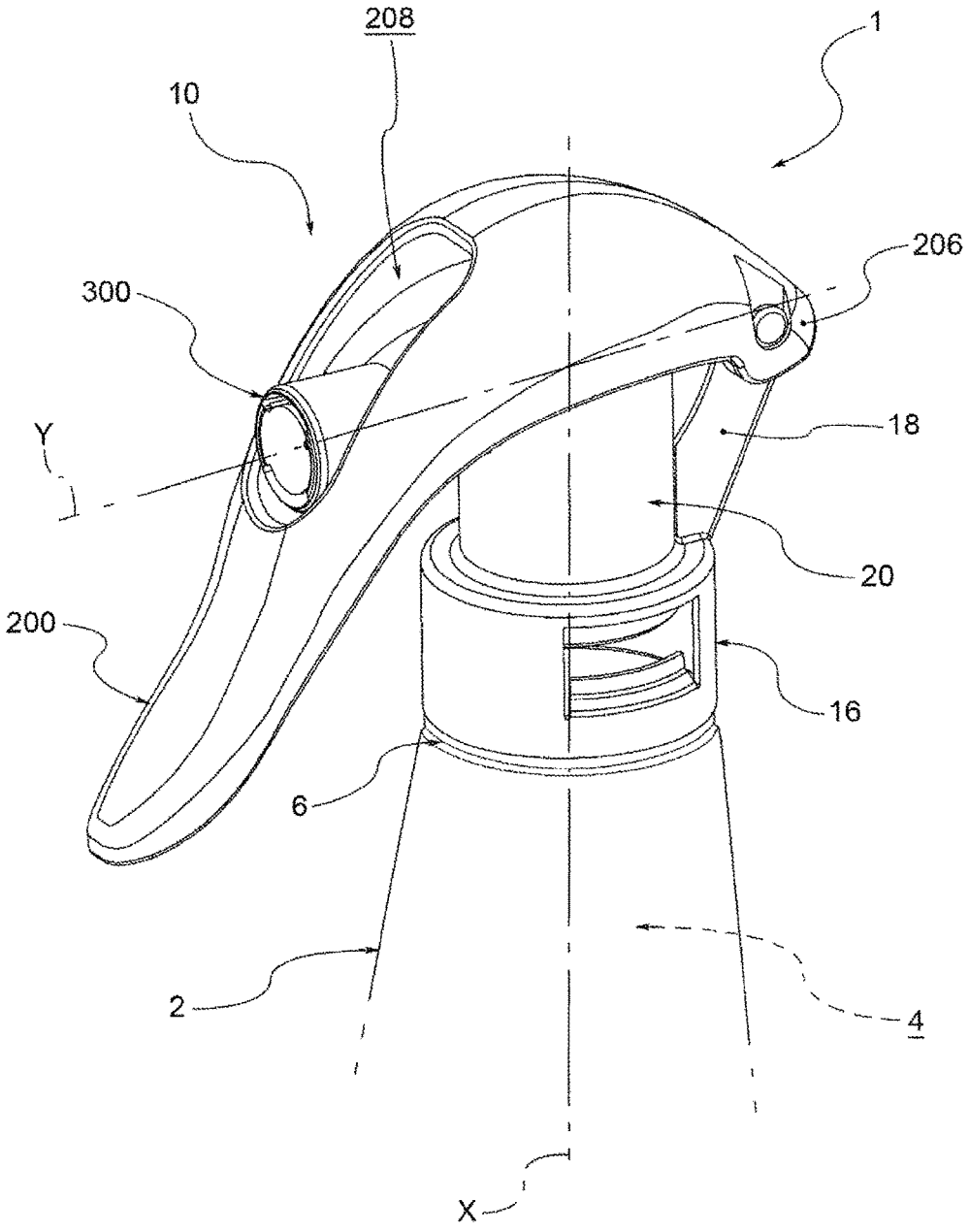
FIG. 1 shows a dispensing device according to this invention, comprising a bottle and a dispensing head engaged to each other.
Figure 2:
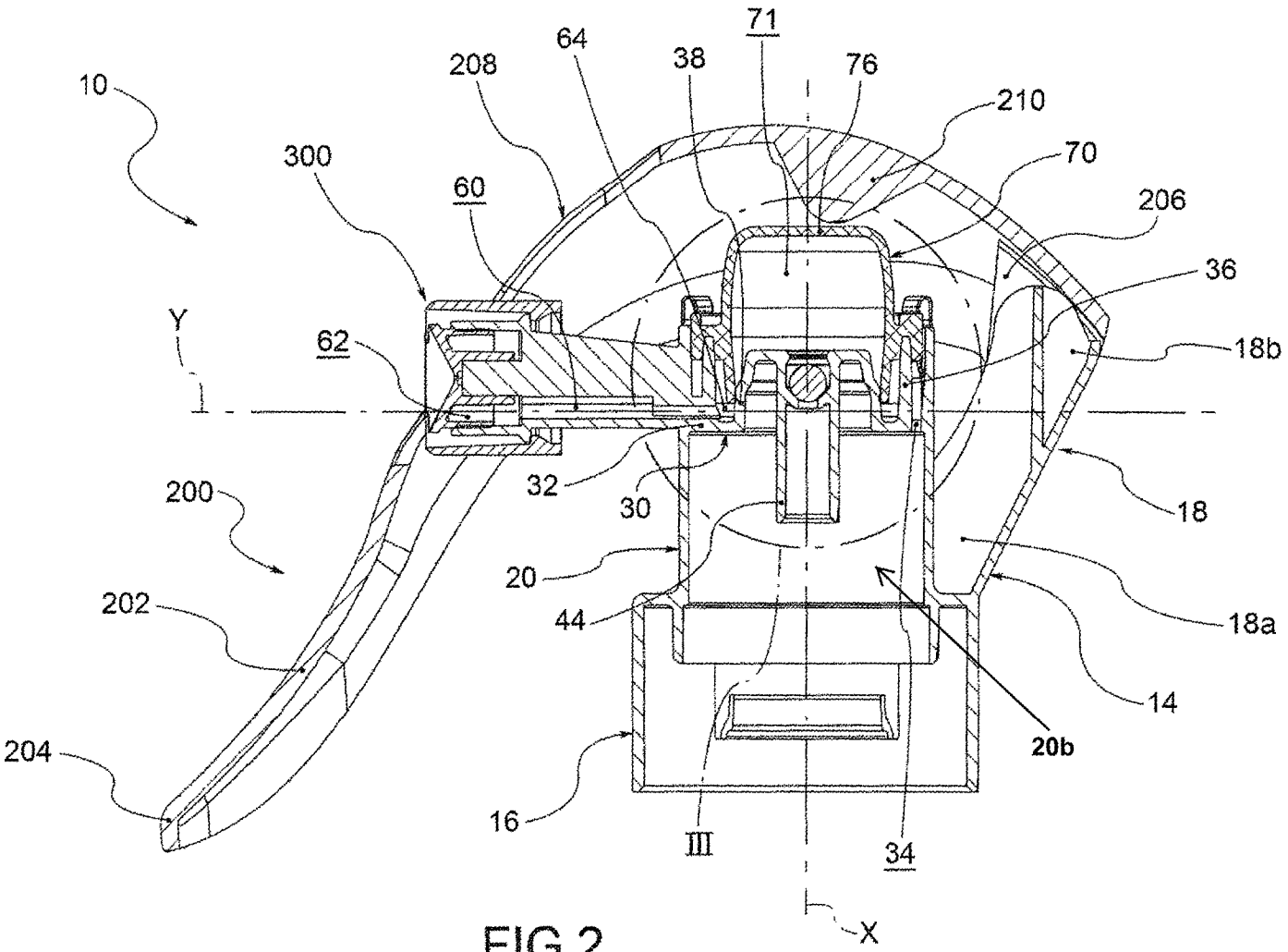
FIG. 2 shows a sectional view of the dispensing head of FIG. 1.
Figure 3:
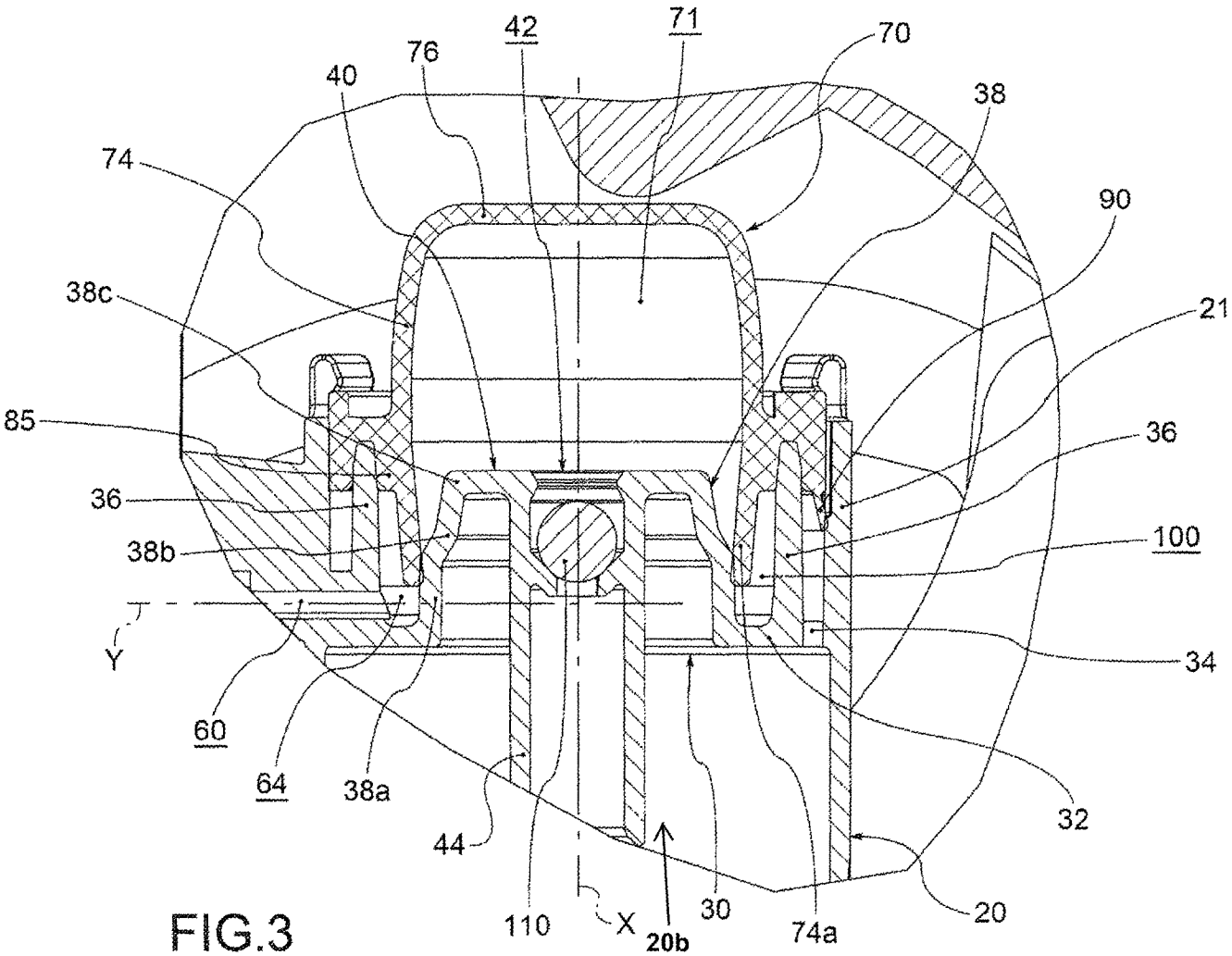
FIG. 3 shows an enlargement of detail III in FIG. 2.
Figure 4:
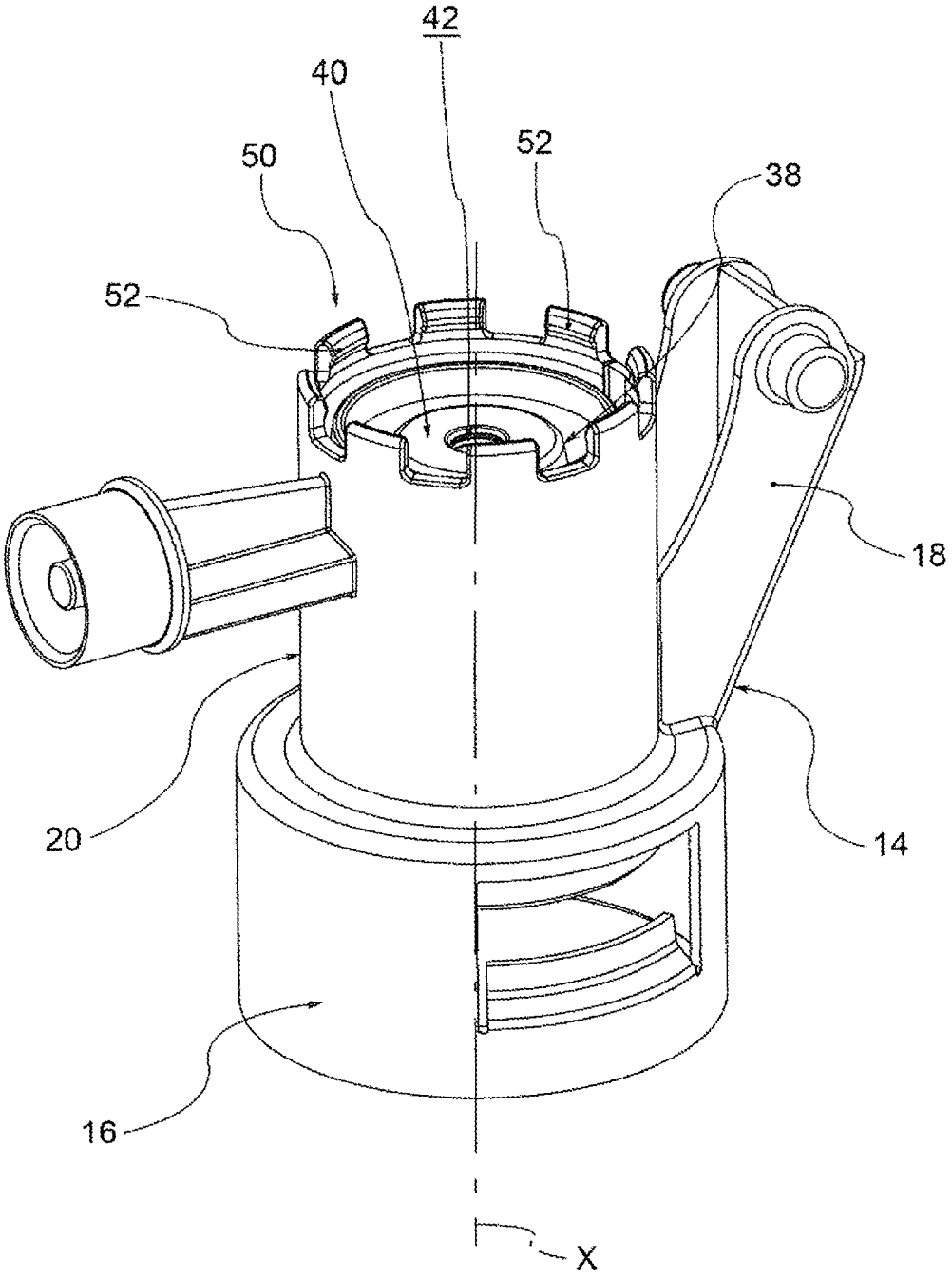
FIG. 4 shows a view of a frame of the dispensing head of FIG. 2.
Figure 5:
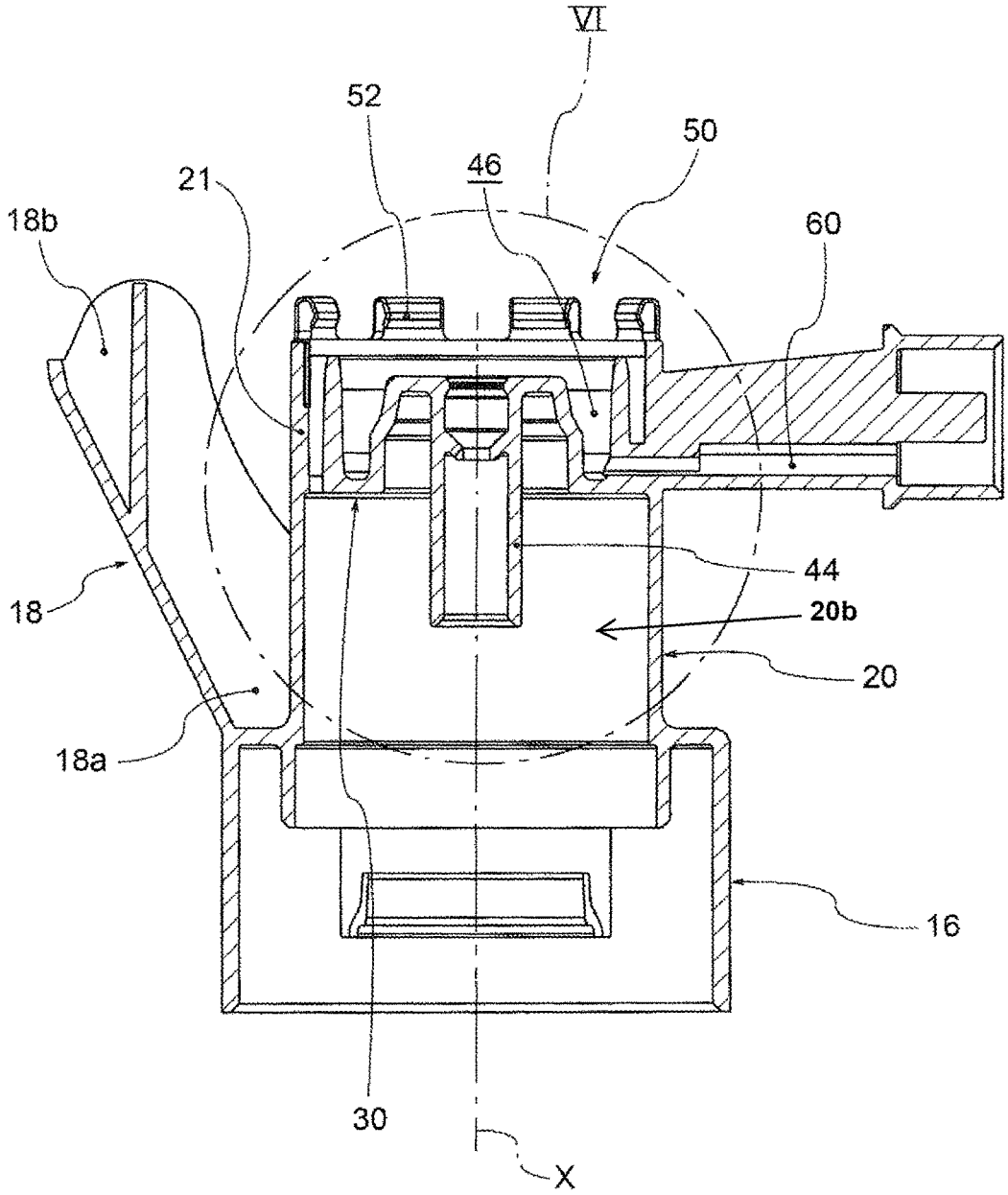
FIG. 5 shows a sectional view of the frame of FIG. 4.
Figure 6:
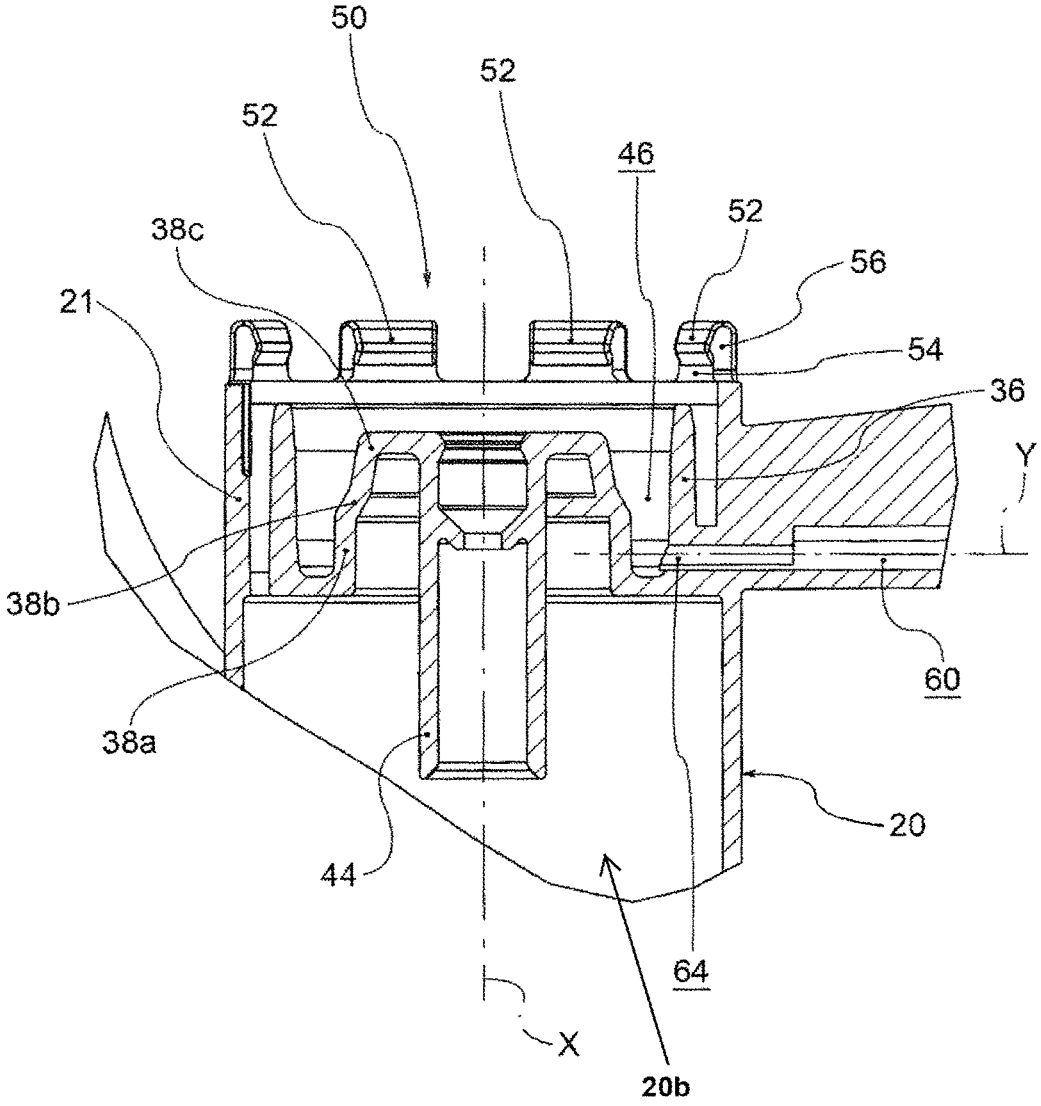
FIG. 6 shows an enlargement of detail VI in FIG. 5.
Figures 7, 8, 9:
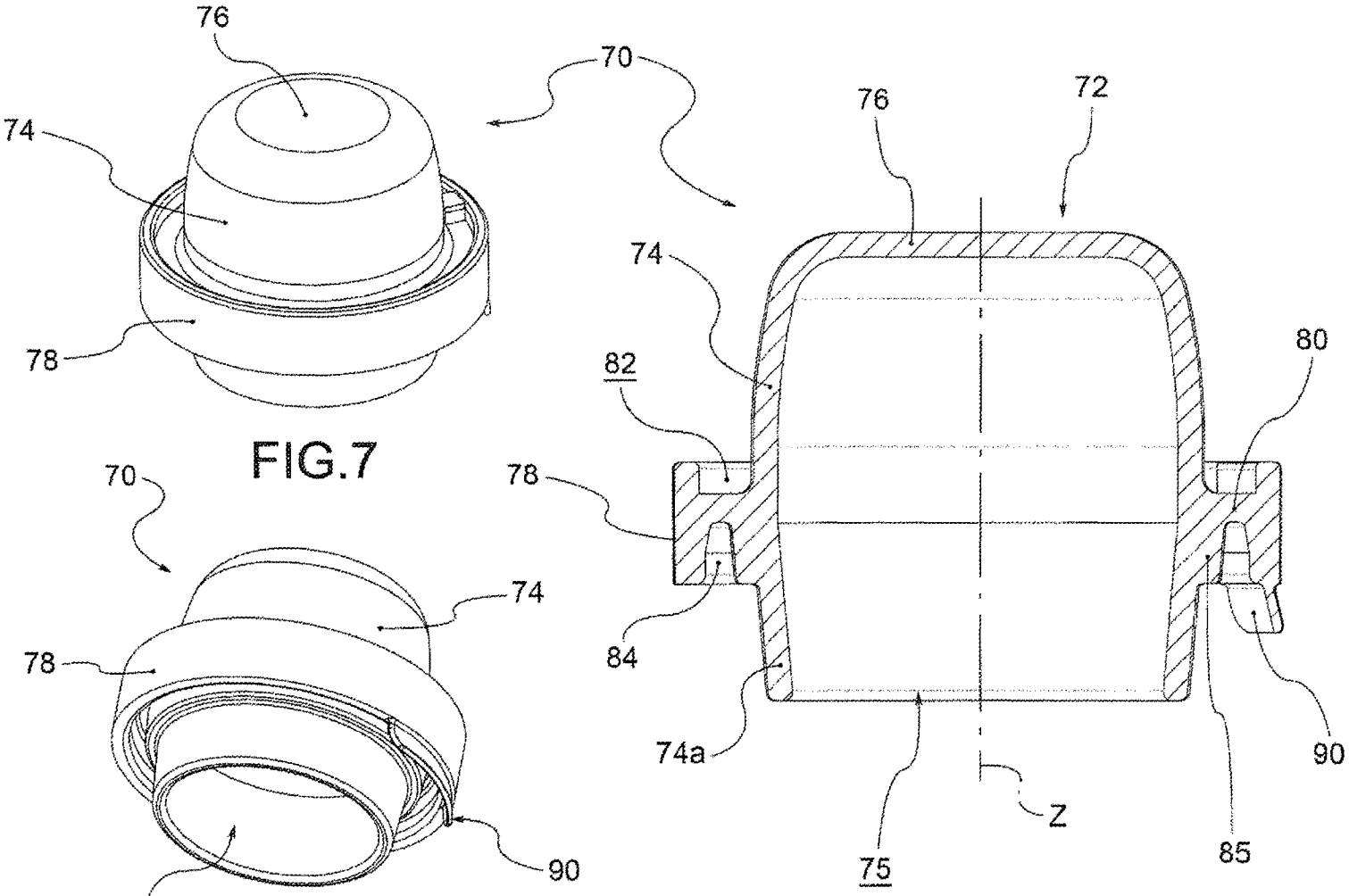
FIGS. 7 and 8 show a view of a bulb of the dispensing head of FIG. 2.
FIG. 9 shows a sectional view of the bulb of FIGS. 7 and 8.

With reference to the attached figures, reference 1 generally indicates a manual trigger dispensing device.

The device 1 comprises a bottle 2, provided with a containment compartment 4 for containing a liquid, and a dispensing head 10, generally pre-assembled, applicable to the bottle 2.

For example, the bottle 2 is provided with a neck 6 for connection to the head 10.

For example, the head 10 is provided with a snap or bayonet system for connection with the neck 6.

According to a further example, the neck is externally threaded and the head is provided with a ring nut threaded for connection to the neck.

The head 10 comprises a frame 14 for the support of components of said head, for example provided with a base foot 16 engageable, by snap or bayonet connection, with the neck 6 of the bottle 2.

Preferably, the base foot 16 has a circular cylindrical shape and defines a main axis X that identifies the direction of insertion and engagement of the frame 14 to the neck 6.

According to a preferred embodiment, the frame 14 comprises a support branch 18 that extends from an end 18*a* proximal to the main axis X, for example in correspondence of the base foot 16, to an end 18*b* distal from the main axis X, diverging from it.

Additionally, the frame 14 preferably comprises an annular spacer wall 20, contiguous to the base foot 16, for example of circular cylindrical shape and having the same main axis X.

The spacer wall 20, which delimits internally a compartment 20*b*, presents a predefined axial extent and preferably an outer diameter smaller than the outer diameter of the base foot 16.

The head 10 also comprises an annular auxiliary wall 21, preferably contiguous to the spacer wall 20, having a predefined axial extension; for example, said auxiliary wall 21 constitutes an axial extension of the spacer wall 20 and, preferably, is made in a single piece with it.

The head 10 also comprises a separation wall 30, located radially internally to the spacer wall 20, arranged to close, at least partially, the compartment 20*b* internal to said spacer wall 20. The auxiliary wall 21 extends axially projecting from the separation wall 30 from the side opposite the spacer wall 20.

Preferably, said separation wall 30 is made in a single piece and, preferably, in a single piece with the frame 14.

The separation wall 30 comprises an outer crown 32, for example joined, at least for a section, with the spacer wall 20 and, for another section, separated from it, so as to realize a vent passage 34 that crosses said separation wall 30.

Preferably, the outer crown 32 is substantially lying on a plane perpendicular to the main axis X.

The separation wall 30 also comprises an annular outer skirt 36, having axial extension, that, at least for a part of it, delimits said vent passage 34 together with the auxiliary wall 21.

Additionally, the wall vent 30 comprises an annular inner skirt 38, having axial extension, on the same side of the outer skirt 36, disposed radially inside said outer skirt 36, joined to the inner terminal edge of the outer crown 32.

Preferably, the said inner skirt 38 has a first band 38*a*, joined to the outer crown 32, an intermediate band 38*b*, joined to the first band 38*a* and having a truncated-conical shape converging distally toward the major axis X, and a terminal band 38*c*, joined to the intermediate band 38*b*, preferably having a truncated-conical shape converging distally toward the major axis X, for example, with less pronounced inclination of the intermediate band 38*b*.

Moreover, the separation wall 30 comprises an inner crown 40, disposed radially internally of the inner skirt 38, substantially disposed on a plane perpendicular to the main axis X.

The internal crown 40 has an inlet opening 42 passing through the thickness, from which extends an aspiration duct 44 of the separation wall 30, for example coaxial with the main axis X.

In other words, the frame 14 has:

said vent passage 34 delimited radially between at least one angular portion of the outer skirt 36 and an angular portion of the auxiliary wall 21, suitable to put the compartment 4*b* in communication with the external environment, and an annular engagement compartment 46, radially delimited between the outer skirt 36 and the inner skirt 38.

Furthermore, the head 10 comprises an attachment rim 50, preferably made in one piece with the frame 14, disposed at the top of said frame 14, for example at the axial end edge of the auxiliary wall 21.

Said attachment rim 50 comprises a plurality of attachment fins 52 angularly spaced and disposed circumferentially along said axial end edge of the auxiliary wall 21.

Preferably each attachment fin 52 has a foot 54, coupled to the auxiliary wall 21, and an enlarged portion 56 that forms a bulge with respect to the foot 54, projecting radially internally.

Preferably, said enlarged portion 56 is flared at the top, as an invitation to insertion.

Furthermore, the head 10 comprises a dispenser duct 60 for dispensing the liquid to the outside; preferably, the said dispenser duct is realized inside the frame 14 and, preferably, extends along a dispensing axis Y incident to the main axis X, preferably perpendicular to it.

In particular, the dispenser duct 60 extends between an outlet end 62 distal, and an inlet end 64 proximal to the main axis X, which opens into the engagement compartment 46.

The head 10 also comprises a bulb 70 applicable to the frame 14 to realize a pressure chamber 71 suitable to be placed in communication with the aspiration duct 44 to receive the liquid to be dispensed and suitable to be placed in communication with the dispenser duct 60 for dispensing the liquid to the outside.

The bulb 70 is preferably made in one piece from a manually compressible elastic material, for example an Ethylene-Vinyl Acetate (EVA) polymer.

The bulb 70 comprises an annular casing 72, preferably made in one piece from a manually compressible elastic material, for example an Ethylene-Vinyl Acetate (EVA) polymer.

The casing 72 comprises a side wall 74 having a bulb axis Z, for example coincident, with the head assembled, with the main axis X of the frame 14.

Preferably, in the undeformed configuration, the side wall 74 has an arched barrel shape and ends with an end region 74*a* the end of which delimits an opening 75 of the bulb 70.

The casing 72 also comprises a head base 76, connected to the side wall, that closes the casing from the side opposite the opening 75. Preferably, the head base 76 is disposed on a plane substantially perpendicular to the bulb axis Z.

The bulb 70 further comprises a belt 78 that surrounds the side wall 74, radially spaced from it (for example, said belt 78 has a circular cylindrical ring shape), and a union wall 80 that unites the belt 78 with the side wall 74.

On the side of the head base 76, the belt 78 terminates axially in prominence relative to the union wall 80, so as to form an annular discharge compartment 82.

Similarly, from the opposite side, the belt 78 terminates axially in prominence with respect to the union wall 80, so as to form an annular engagement seat 82.

Preferably, in correspondence with the engagement seat 84, the casing 72 has a sealing wall 85, projecting from the side wall 74.

The bulb 70 further comprises a vent lip 90 projecting from the side wall 74, for example projecting from belt 78, on the side opposite the head base 76, diverging distally from the main axis X.

The lip 90 has a predefined, limited angular extension; in other words, said lip does not extend annularly with continuity. For example: the lip 90 has an angular extension between 50° and 70°, preferably equal to 60°.

The bulb 70 is applicable to the frame 14, in a stable manner for the functioning of the device 1, by virtue of the attachment rim 50, which therefore realizes an embodiment example of coupling means suitable to stably couple the bulb 70 to the separation wall 30.

In particular, for the application of the bulb 70 to the frame 14, the bulb axis Z is for example aligned with the main axis X of the frame and the bulb 70 and, by translation, goes to interfere with the attachment fins 52, continuing to advance, until the belt 78 snap engages with them.

When the bulb 70 is applied to the frame 14, the casing 72 and at least a part of the separation wall 30 delimit the pressure chamber 71.

In addition, the end region 74*a* of the side wall 74 is received in the engagement compartment 46, in sealing contact with the inner skirt 38, and in particular in contact with the first band 38*a* of it.

The side wall 74 and the inner skirt 38, in contact between them, realize an example of valve dispensing means suitable to allow the passage of liquid from the pressure chamber 71 to the dispenser duct 60 when the liquid in the pressure chamber 71 is placed under pressure and suitable to prevent the passage of liquid from the pressure chamber 71 to the dispenser duct 60 when the liquid is not under pressure.

In addition, the sealing wall 85 of the casing 72 is placed in sealing contact with the outer skirt 36 of the separation wall 30 (and the free end of the outer skirt 36 is inserted in the engagement seat 84 of the bulb 70.

Therefore, the sealing wall 85 and the end region 74*a* of the casing 72 of the bulb 70 and the outer crown 32 of the separation wall 30 define an intermediate chamber 100 into which opens the dispenser duct 60 and in which the liquid exiting the pressure chamber 71 passes during dispensing, before be channelled in the dispenser duct 60.

In addition, the vent lip 90 of the bulb 70 is placed in sealing contact with the auxiliary wall 21, blocking the vent passage 34.

The vent lip 90 of the bulb 70 and the auxiliary wall 21 therefore create valve vent means suitable to allow the passage of air from the outside towards the inside of the bottle during a suction phase of the liquid from the bottle to the pressure chamber and suitable to prevent the leakage of the liquid from the bottle to the outside environment during other conditions of the device.

Furthermore, the head 10 comprises valve suction means suitable to allow the passage of liquid from the bottle to the pressure chamber during a phase of suction of the liquid and suitable to prevent the return of the liquid from the pressure chamber to the bottle during a dispensing phase of the liquid.

According to an embodiment, said valve suction means comprise an obturator 110, for example a ball, engageable with the aspiration duct 44.

According to further embodiments, said valve suction means are of the deformable membrane type. An embodiment example of such valve membrane suction means is for example shown in International Application WO-A1-2011/128788 in the name of the Applicant, whose teaching is incorporated here.

Furthermore, the head 10 includes a trigger 200, engaged with the frame 14 in a rotatable or translatable manner, to operate the device 1.

According to a preferred embodiment, the trigger 200 comprises an actuating portion 202, suitable to be actuated by the fingers of a user ending at a free end 204 radially spaced from the main axis X, and a hinge portion 206, arranged on the side opposite the free end 18 with respect to the main axis X and hinged to the frame 14.

In other words, the trigger 200 extends astride the main axis X.

In addition, the trigger 200 has a front window 208, from which extends the dispenser duct 60 or nozzle 300 associated to it, and a pressure element 210 projecting and disposed to operate for the compression of the casing 72 of the bulb 70 and the consequent dispensing of the liquid.

During normal functioning of the device 1, in an initial condition of rest the valve dispensing means are in a closed configuration, in which the end region 74*a* of the side wall 74 is in sealing contact with the inner skirt 38 of the separation wall 30, and the trigger is in an advanced limit position.

Moreover, the valve suction means are in a closed configuration; in fact, even if the device is placed horizontally or upside down, no liquid leaks out through the vent passage 34, as this is obstructed by the vent lip 90 in sealing contact with the auxiliary wall 21.

In a dispensing step, starting from the rest condition, the actuation of the trigger 200 toward a retracted position leads to the deformation of the casing 72 of the bulb 70 via the pressure element 210 that operates on its head base 76; consequently, the liquid contained in the pressure chamber 71 brings the valve dispensing means to an opening configuration, in which the side wall 74, and in particular the end region 74*a* of it, is separated from the inner skirt 38 of the separation wall 30. The liquid flows out into the intermediate chamber 100 and then is channelled into the dispenser duct 60.

During the dispensing phase, the valve suction means are forced towards a closed configuration, in which the obturator 102 prevents the return of the liquid from the pressure chamber 71 to the bottle.

When the trigger 200 is released, the intrinsic elasticity of the casing 72 of the bulb 70 operates to bring the device to the rest condition through a suction phase.

During the suction phase, the vacuum that is created in the pressure chamber 71 brings the valve dispensing means to the closed configuration in which the side wall 74 of the casing 72 restores the sealing contact with the inner skirt 38, and the valve suction means suction in the open configuration, so that the liquid is aspirated from the inner compartment 4 of the bottle in the pressure chamber 71, through the aspiration duct 44.

During the suction phase, the vacuum that is created in the inner compartment 4 of the bottle due to the aspiration of part of the liquid operates in opening the valve vent means, bringing them automatically in an open configuration in which the vent lip 90 is separated from the auxiliary wall 21 and allows the entry of air from the outside towards the inner compartment 4 of the bottle 2.

Innovatively, the dispenser device according to this invention allows obtaining a remarkable constructive simplicity, thanks to the integration of one or more valve means into a single component, and maintaining an excellent functionality at the same time.

In particular, advantageously, the vent lip, of limited angular extension, allows a rapid response in opening during the suction phase, avoiding jamming of the device, a distortion of the casing of the bulb or a deformation of the bottle.

Advantageously, moreover, the device according to this invention allows high speed of production and assembly, in virtue of snap application of the bulb to the frame.

It is clear that one skilled in the art, in order to meet contingent needs, may make changes to the device described above, all contained within the scope of protection defined by the following claims.

The invention claimed is:

1. A trigger dispensing head for a liquid, mounted on a bottle, comprising:

a frame comprising an annular spacer wall defining a main axis and internally delimits a compartment;

a separation wall which cooperates with the annular spacer wall to close at least partially the compartment, wherein the separation wall is crossed by a vent passage, the compartment being in communication with the external environment through the vent passage;

a trigger, rotatably or translatably engaged with the frame;

a bulb coupled to the separation wall, comprising an elastically deformable casing which, together with the separation wall, delimits a pressure chamber;

a dispensing duct in communication with the pressure chamber to dispense the liquid outwards;

a coupler for the stable coupling of the bulb to the separation wall, the coupler comprising an attachment rim arranged at one axial end edge of an auxiliary wall;

wherein the bulb comprises a vent lip, molded in one piece with the casing, the vent lip sealingly closing the vent passage to form a venting valve; and wherein said coupler for the stable coupling of the bulb further comprises a plurality of attachment fins angularly spaced and disposed circumferentially along said axial end edge of the auxiliary wall;

wherein each attachment fin has a foot, coupled to the auxiliary wall, and an enlarged portion that forms a bulge with respect to the foot, projecting radially internally; and wherein the attachment fins interfere with the bulb by the enlarged portion and form a stable coupling to the separation wall on an imaginary plane perpendicular to the main axis.

2. Head according to claim 1, wherein the lip has a predefined limited angular movement and rotates less than 360 degrees when opening.

3. Head according to claim 2, wherein the lip has an angular extension between 50° and 70°.

4. Head according to claim 1, wherein the casing comprises an annular side wall ending with an end region and the separation wall comprises an inner skirt having axial extension, and wherein the end region of the annular side wall seals with the inner skirt of the separation wall to form a valve dispenser.

5. Head according to claim 1, wherein the casing comprises a sealing wall and the separation wall comprises an outer skirt having axial extension, and wherein the sealing wall of the casing is placed in sealing contact with the outer skirt of the separation wall and at least partly defines an intermediate chamber into which the dispensing duct opens.

6. Head according to claim 1, wherein the bulb comprises a belt surrounding the casing, radially spaced from the casing, and the vent lip protrudes from the belt.

7. Head according to claim 6, wherein the belt is inserted between the auxiliary wall and an outer skirt of the separation wall having axial extension.

8. Head according to claim 1, wherein the enlarged portion is flared upward.

9. Head according to claim 1, wherein the separation wall is molded in a single piece with the frame.

10. Head according to claim 1, wherein the auxiliary wall is molded in a single piece with the frame.

11. Head according to claim 1, wherein the bulb is molded in a single piece.

12. Head according to claim 1, wherein the trigger comprises an actuating portion, operable by the fingers of a user and ending at a free end radially spaced from the main axis, and a hinge portion, arranged on the side opposite the free end with respect to the main axis and hinged to the frame.

13. A trigger dispenser for a liquid, comprising:

a bottle;

a trigger dispensing head mounted on the bottle, comprising:

a frame comprising an annular spacer wall which defines a main axis and internally delimits a compartment;

a separation wall which cooperates with the annular spacer wall to close at least partially the compartment, wherein the separation wall is crossed by a vent passage, the compartment being in communication with the external environment through the vent passage;

a trigger, rotatably or translatably engaged with the frame;

a bulb coupled to the separation wall, comprising an elastically deformable casing which, together with the separation wall, delimits a pressure chamber;

a dispensing duct in communication with the pressure chamber to dispense the liquid outwards;

a coupler for stable coupling of the bulb to the separation wall, the coupler comprising an attachment rim arranged at one axial end edge of an auxiliary wall and said coupler further comprising a plurality of attachment fins angularly spaced and disposed circumferentially along the axial end edge of the auxiliary wall;

wherein the bulb comprises a vent lip, molded in one piece with the casing, the vent lip sealingly closing the vent passage to form a venting valve;

wherein each of the attachment fins has a foot, coupled to the auxiliary wall, and an enlarged portion that forms a bulge with respect to the foot, projecting radially internally;

wherein the attachment fins interfere with the bulb by the enlarged portion and form a stable coupling to the separation wall on an imaginary plane perpendicular to the main axis.

* * * * *